US007109953B2

(12) United States Patent
Abe et al.

(10) Patent No.: US 7,109,953 B2
(45) Date of Patent: Sep. 19, 2006

(54) DRIVE CIRCUIT OF ACTIVE MATRIX TYPE ORGANIC EL PANEL AND ORGANIC EL DISPLAY DEVICE USING THE SAME DRIVE CIRCUIT

(75) Inventors: Shinichi Abe, Kyoto (JP); Masanori Fujisawa, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 356 days.

(21) Appl. No.: 10/463,579

(22) Filed: Jun. 18, 2003

(65) Prior Publication Data

US 2003/0234754 A1 Dec. 25, 2003

(30) Foreign Application Priority Data

Jun. 20, 2002 (JP) ..... 2002-179439

(51) Int. Cl.
*G09G 3/30* (2006.01)

(52) U.S. Cl. ..... 345/76; 315/169.3; 345/212; 345/213

(58) Field of Classification Search ..... 345/45, 345/212, 214, 76, 77, 82, 84; 315/169.3; 178/18.01, 19.01, 19.07, 19.06, 19.03
See application file for complete search history.

(56) References Cited

U.S. PATENT DOCUMENTS 5,629,715 A * 5/1997 Zenda ..... 345/211
6,404,136 B1 * 6/2002 Murray et al. ..... 315/169.1
6,586,888 B1 * 7/2003 Kitahara et al. ..... 315/169.1
6,693,388 B1 * 2/2004 Oomura ..... 315/169.3
6,756,738 B1 * 6/2004 Maede et al. ..... 315/169.1
2002/0075208 A1 * 6/2002 Bae et al. ..... 345/76
2003/0011314 A1 * 1/2003 Numao ..... 315/169.3

FOREIGN PATENT DOCUMENTS

| | | |
|---|---|---|
| JP | 63-280568 | 11/1988 |
| JP | 10-112391 | 4/1998 |
| JP | 2000-221942 | 7/2000 |

* cited by examiner

*Primary Examiner*—Amr A. Awad
*Assistant Examiner*—William Boddie
(74) *Attorney, Agent, or Firm*—Mattingly, Stanger, Malur & Brundidge, P.C.

(57) ABSTRACT

A drive current value is regulated by a current value regulator circuit of a current drive circuit provided externally of each pixel circuit, so that control lines for a program control provided in order to unify operating threshold values of drive transistors becomes unnecessary. Therefore, the number of transistors of each pixel circuit can be reduced and the circuit size of each pixel circuit can be reduced thereby.

8 Claims, 5 Drawing Sheets

DRIVE CIRCUIT OF ACTIVE MATRIX TYPE ORGANIC EL PANEL AND ORGANIC EL DISPLAY DEVICE USING THE SAME DRIVE CIRCUIT

BACKGROUND OF THE INVENTION

1. Field of the Invention

The present invention relates to a drive circuit of an active matrix type organic EL panel and an organic EL display device using the drive circuit and, in particular, the present invention relates to an active matrix type organic EL display device, which can reduce luminance unevenness of a display screen of a portable telephone set or PHS, etc., even when the size of pixel circuit is restricted by removing a circuit for compensating for an operating threshold value of drive transistors and is suitable for high luminance color display.

2. Description of the Prior Art

It has been known that an organic EL display device, which realizes a high luminance display by spontaneous light emission, is suitable for a display on a small display screen and the organic EL display device has been attracting public attention as the next generation display device to be mounted on a portable telephone set, a PHS, a DVD player or a PDA (Personal Digital Assistants), etc. Known problems of such organic EL display device are that, since, when it is driven by voltage as in a liquid crystal display device, luminance variation thereof becomes substantial and that, since there is difference in sensitivity of organic EL element between R (red), G (green) and B (blue), a control of luminance of a color display becomes difficult.

In view of these problems, an organic EL display device using current drive circuits has been proposed recently. For example, JPH10-112391A discloses a technique in which the luminance variation problem is solved by employing a current drive system.

An organic EL display panel of an organic EL display device for a portable telephone set, a PHS, etc., having 396 (=132×3) terminal pins for column lines and 162 terminal pins for row lines has been proposed. However, there is a tendency that the number of column lines as well as row lines is further increased.

An output stage of a current drive circuit of such organic EL display panel of either the active matrix type or the passive matrix type includes a current source drive circuit, such as an output circuit constructed with a current mirror circuit, for each of the terminal pins.

In the active matrix type organic EL display device, a pixel circuit composed of a capacitor and a current drive transistor is provided for each display pixel. The transistor of the pixel circuit is driven by a voltage stored in the capacitor and the organic EL element (referred to as OEL element, hereinafter) is current-driven by the transistor. A drive system therefor is a digital drive system in which the OEL element is binary-controlled by ON/OFF of the transistor or an analog drive system in which a drive current of the OEL element is controlled by an analog input data. In the case of the digital drive, a display area is controlled by providing a sub pixel in the pixel or a color tone of a display pixel is controlled according to a difference of a drive time by time-dividing a light emitting time. The analog drive system is classified to a voltage assigning type system (voltage program system) and a current assigning type system (current program system). In the voltage assigning type analog drive system, a terminal voltage of the capacitor of each pixel circuit is set by a voltage signal and, in the current assigning type analog drive system, the terminal voltage of the capacitor is set by a current signal.

In such active matrix type organic EL display device, luminance unevenness tends to occur due to variation of operating threshold value of the drive transistor in each of the pixel circuits. Since it is difficult to make the operating thresholds of the drive transistors of the respective pixel circuit uniform during a fabrication process of the display device, it has been considered to restrict the luminance unevenness by controlling the voltages of the capacitors of the respective pixel circuits. In order to realize such scheme, a threshold value compensation circuit is provided within the pixel circuit. Examples of the threshold value compensation circuit are of the voltage program type and the current program type.

The voltage program type threshold value compensation circuit utilizes four transistors and two capacitors provided in each pixel circuit and two wiring lines for compensating for variation of the operating threshold value of the drive transistors are provided in addition to data lines and selection lines. The current drive is performed without influence of the threshold values of the drive transistors by charging the two capacitors by control signals to the two lines with predetermined timing.

In the current program system, the pixel circuit includes three transistors, which includes the drive transistor, and a switching transistor for setting a specific voltage. Further, the pixel circuit includes a data line, two selection lines and a power source line (source line) of a specific voltage Vdd. First, the drive transistor is separated by the switching transistor to charge the capacitor by current drive and then the drive transistor is connected to the capacitor by the switching transistor and the OEL element is current-driven by supplying power from the source line.

Each of these drive methods requires a program timing control. Particularly, in the current drive system, the preciseness of current value required for intermediate tone display control becomes 0.1 μA or smaller. Therefore, the control itself becomes difficult. Further, when the density of display pixels becomes as high as, for example, VGA, SVGA, XGA, etc., the circuit size of each pixel circuit becomes large since the program timing control must be performed within a limited time and lines for the program control are required in addition to the data line and the selection line.

SUMMARY OF THE INVENTION

An object of the present invention is to provide a drive circuit of an active matrix type organic EL panel, which is capable of reducing luminance unevenness of a display screen and is particularly suitable for high luminance color display even when the circuit size of pixel circuit is restricted by removing a circuit for compensating for the operating threshold value of drive transistor.

Another object of the present invention is to provide an organic EL display device, which has a small pixel circuit size and is capable of reducing luminance unevenness of a display screen.

In order to achieve these objects, a drive circuit of an active matrix type organic EL display device and the organic EL display device using the same drive circuit of the present invention is featured by comprising a number of current drive circuits having output pins to be connected to data lines or column pins of an organic EL display panel for generating charging currents for charging capacitors of pixel circuits, to which the output pins are connected through the data lines or the column pins, to predetermined voltage values and a write control circuit for performing a write control for storing the voltage values of the capacitors and a reset control for resetting the voltage values of the capacitors, wherein a plurality of the current drive circuits, which are connected to a plurality of the pixel circuits positioned in at least dispersed locations on a screen of the organic EL display panel through the output pins, include current value regulator circuits for regulating output currents to be discharged from the output pins or to be sunk to the output pins, respectively.

As described above, in the present invention, in addition to the data lines or the current drive lines connected to the column terminal pins, only lines from the write control circuits, for example, scan lines for writing and resetting the voltage values of the capacitors, are required.

In the present invention, since the drive currents are regulated by the current regulation circuits of the current drive circuits provided externally of the respective pixel circuits, the control lines for the program control, which is necessary for unifying the operation threshold values of the drive transistors, are unnecessary. Therefore, the numbers of elements as well as wiring lines of each pixel circuit can be reduced correspondingly. Consequently, the size of each pixel circuit can be reduced.

The current value regulation circuit of the current drive circuit according to the present invention may be provided for every data line or column terminal pin. However, since it is enough to provide it for each of the data lines or the column terminal pins, which are arranged in at least dispersed positions on the organic EL panel, an increase of the circuit size on the organic EL drive circuit side can be restricted.

Therefore, it is possible to regulate drive currents by externally current-driving the organic EL panel by the external drive circuit while restricting each pixel circuit construction of the active type organic EL panel. The regulation is performed by providing the current regulation circuit in each of the plurality of the current drive circuits for driving the pixel circuits located in at least the dispersed positions in the display screen and regulating the drive current values of the pixel circuits by the current regulator circuits in such a way that luminance unevenness becomes unconscious. Thus, it is possible to restrict luminance unevenness of the display screen regardless of variation of the operating threshold value of the drive transistors of the pixel circuits. It is, of course, possible to further reduce the luminance unevenness by providing the current drive circuit having current value regulation circuit for ever data line or column terminal pin.

As a result, it is possible to restrict the circuit size of each pixel circuit by removing the circuit for compensating for the operating threshold value of the drive transistor and to reduce the luminance unevenness of the display screen.

DETAILED DESCRIPTION OF THE PREFERRED EMBODIMENTS

Figure 1:
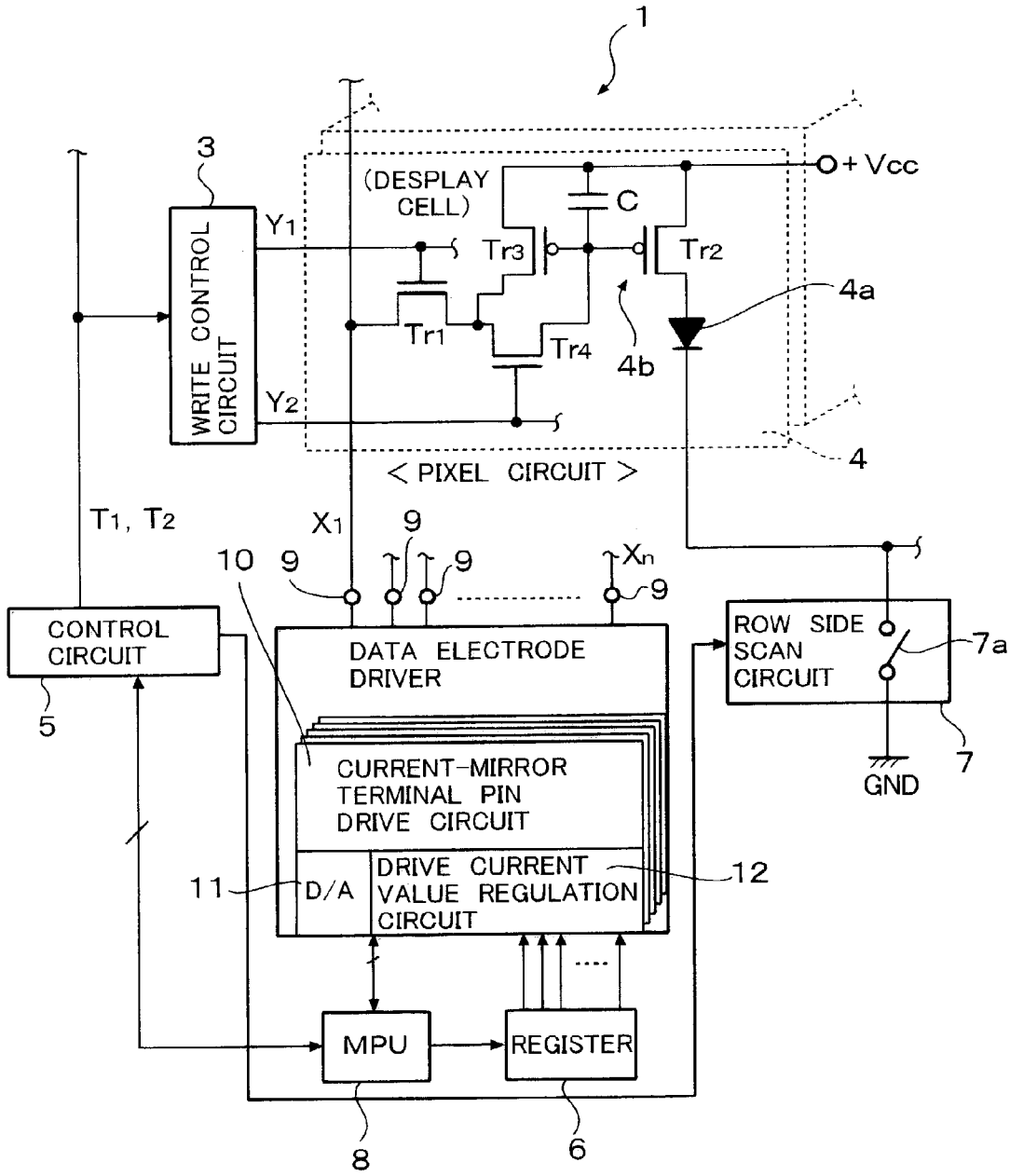
FIG. 1 is a block circuit diagram of an active matrix type organic EL display device according to an embodiment of the present invention.

FIG. 1 is a block circuit diagram of an active matrix type organic EL display device 1. The active matrix type organic EL display device 1 includes a data electrode driver 2, a write control circuit 3, a pixel circuit 4, a control circuit 5, a register 6, a row side scan circuit 7 and an MPU 8, etc. Incidentally, the pixel circuit 4 is provided at every cross point of X and Y matrix lines and only one pixel circuit is shown in FIG. 1 as an representative of the pixel circuits.

The data electrode driver 2 is a column driver of an organic EL element drive circuit in a horizontal scan direction and includes a plurality of current-mirror terminal pin drive circuits (referred to as "current drive circuits", hereinafter) 10 provided correspondingly to respective data lines (or column terminal pins). An output pin 9 of each current-mirror output stage circuit 13 (FIG. 2) is connected to one of the data lines (X1, . . . , Xn) of the X and Y matrix lines (data lines and scan lines).

Figure 2:
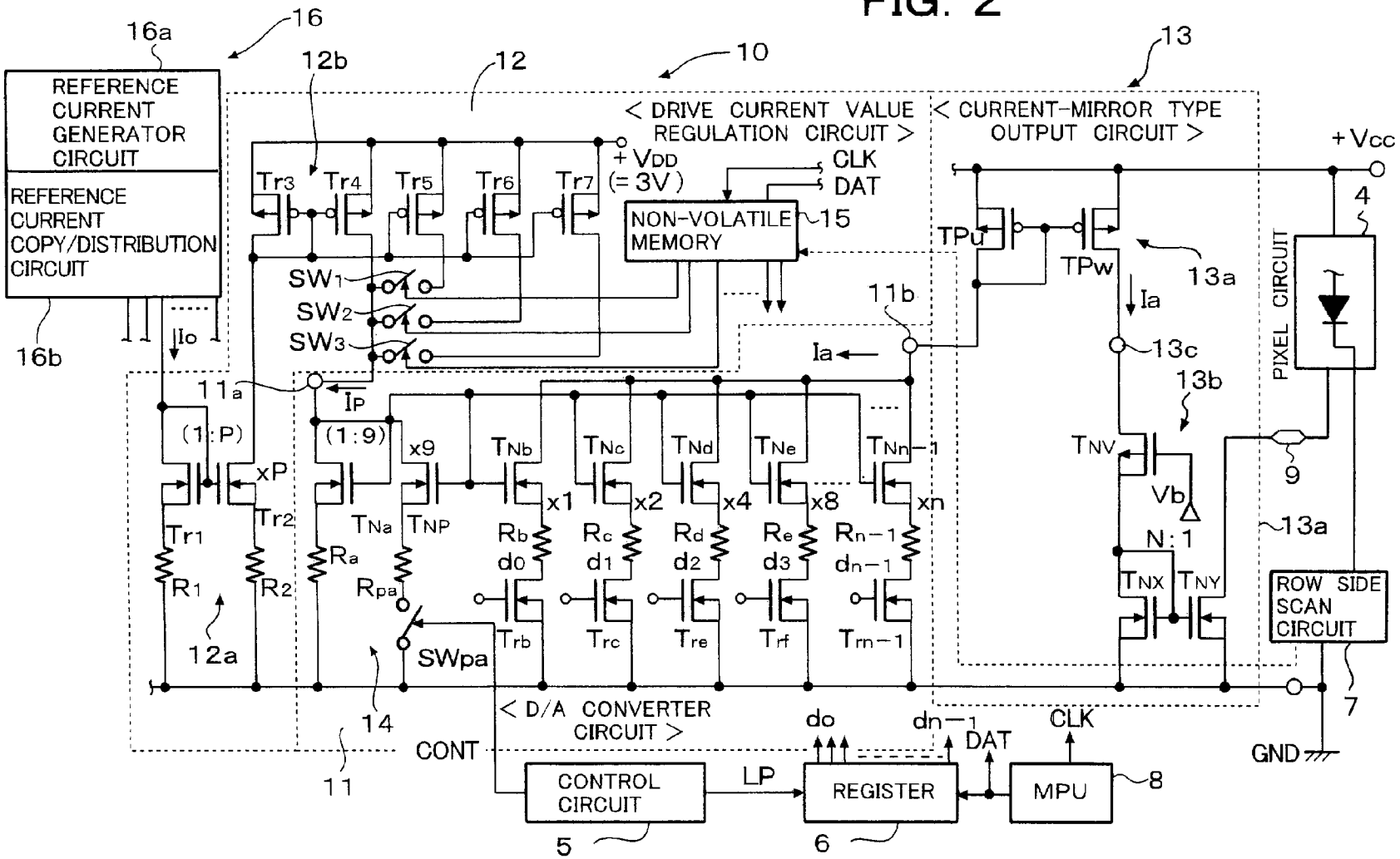
FIG. 2 is a circuit diagram of a current-mirror type terminal pin drive circuit having a current value regulation circuit as a data electrode driver of the active matrix type organic EL display device shown in FIG. 1.

As shown in FIG. 1 and FIG. 2, the pixel circuit (display cell) 4 is provided at the cross point of the X and Y matrix lines (one of the data lines X1, . . . , Xn and one of the scan lines Y1, Y2, . . . ) and an N channel MOS transistor Tr1 having a source and a gate, which are connected to the cross point of the data line and the scan line Y1, is arranged within the pixel circuit 4. An OEL element 4*a* is driven by a drive transistor Tr2, which is a P channel MOS transistor provided within the pixel circuit 4. A capacitor C is connected between a gate and a source of the transistor Tr2. The source of the transistor Tr2 is connected to a power source line +Vcc, which is, for example, about +7V. A cathode of the OEL element 4*a* is connected to a switch circuit 7*a* of the row side scan circuit 7 and can be grounded through the switch circuit 7*a*.

In the pixel circuit 4, a P channel MOS transistor Tr3 and an N channel MOS transistor Tr4 are provided between the transistor Tr1 and the transistor Tr2. The transistor Tr3 is an input side transistor, which constructs a current-mirror circuit 4*b* together with the transistor Tr2 as its output side transistor. A drain of the transistor Tr1 is connected to a downstream side of the transistor Tr3 and a source and a drain of the transistor Tr4 are connected between a connecting point between the transistors Tr3 and Tr1 and a common gate (the gate of the transistor Tr2) of the current-mirror circuit 4*b*.

The transistor Tr2 and the transistor Tr3, which constitute the current-mirror circuit, have substantially identical characteristics.

The gate of the transistor Tr1 is connected to the write control circuit 3 through the scan line Y1 (write line) and a gate of the transistor Tr4 is connected to the write control circuit 3 through the scan line Y2 (erase line). The scan line Y1 (write line) and the scan line Y2 (erase line) are scanned by the write control circuit 3 such that the transistor Tr1 and the transistor Tr4 are turned ON when these scan lines become High (H) level, so that the transistor Tr2 is driven by a predetermined drive current and the capacitor C is charged thereby to hold a predetermined drive voltage. As a result, the drive current value is written in the capacitor C. In this case, the capacitor C memorizes it as a voltage value.

The MOS transistor Tr2 is driven by the current corresponding to the stored voltage of the capacitor C. The stored voltage of the capacitor C corresponds to a voltage value corresponding to the written drive current and the OEL element 4*a* is driven by a current corresponding to the written drive current. When channel widths of the transistor Tr2 and the transistor Tr3 are the same, it is possible to generate a drive current, which is the same as the write current.

Incidentally, although the scan line Y1 (write line) and the scan line Y2 (erase line), which are connected to the write control circuit 3 and controlled thereby, are provided for every pixel circuit in vertical direction (for every vertical scan line), only one pixel circuit, which is scanned vertically as the switch circuit 7*a* of the row side scan circuit 7 is shown in FIG. 1. Further, since the switch circuit 7*a* is in OFF stage when the current is written in the capacitor C, the drive current from the transistor Tr2 to the OEL element 4*a* is not generated.

The switch circuit 7*a* of the row side scan circuit 7 becomes ON after a drive currents for one line in horizontal R, G and B scan direction are written in the capacitor C of every pixel circuit (display cell), so that the OEL elements 4*a* for the one line in the horizontal scan direction are driven simultaneously. At this time instance, the scan line Y1 (write line) and the scan line Y2 (erase line) are made "L" state by the write control circuit 3 and the transistor Tr1 and the transistor Tr4 are turned OFF.

The switch circuit 7*a* is provided in the row scan circuit 7 for every vertical scan line and one of the switch circuits 7*a*, which is to be scanned presently, is turned ON and the other switch circuits 7*a* are tuned OFF. Thus, the switch circuits 7*a* become ON sequentially correspondingly to the vertical scan.

Incidentally, in the active matrix type organic EL display device, the capacitors C store the drive current values. Therefore, it may be possible to turn the switch circuits 7*a* ON after the drive currents for not one vertical line but one screen are stored in the capacitors C. In such case, only one switch circuit 7*a* is enough and there is no need of using the row side scan circuit 7. In a case where R, G and B screens are driven in time division manner, the switch circuit 7*a* is provided for every screen, that is, a total of three switch circuits 7*a* are provided.

When the scan line Y2 connected to the write control circuit 3 becomes "H" and the scan line Y1 becomes "L", the capacitor C is discharged. That is, in this case, the transistor Tr1 is turned OFF and the transistor Tr4 is turned ON, so that the capacitor C is discharged through the transistor Tr3 which is ON state by the voltage of. the capacitor C, and the transistor Tr4 and then the voltage of the capacitor C is reset. This resetting is performed immediately before the drive of the OEL elements for one line or during the retrace blanking period. Incidentally, the scan lines Y1 and Y2 corresponding to each pixel circuit 4 are controlled by timing signals T1 and T2 from the control circuit 5 to scan the pixel circuits in the vertical direction.

FIG. 2 shows a concrete circuit diagram of the data electrode driver 2, which includes the n current drive circuits 10 provided correspondingly to the respective data lines X1~Xn and a reference drive current generator circuit 16, where n is the number of data lines. These circuits are provided for every primary color.

The current drive circuit 10 includes a D/A converter circuit 11, a drive current value regulation circuit 12, a current-mirror output stage circuit 13, a peak current generation circuit 14 and a non-volatile memory 15. The reference drive current generator circuit 16 includes a reference current generator circuit 16*a* and a reference current copy/distribution circuit 16*b*.

The reference current generator circuit 16*a* is a programmable constant current source for supplying reference current values, which become display references for the respective R, G and B colors and can be set externally. The reference current copy/distribution circuit 16*b* is constructed with, for example, a current-mirror circuit composed of one input side transistor and output side transistors corresponding in number to the data lines. Each of the reference current values from the reference current generator circuit 16*a* is inputted to the input side transistor and n reference current values are copied in parallel as constant currents Io and distributed from the output side transistors of the current-mirror circuit to the output pins of the current-mirror output stage circuit 13, that is, the terminal pins of the organic EL panel. The constant currents Io are supplied to the respective current drive circuits 10 corresponding to the output pins.

The drive current value regulation circuit 12 of the current drive circuit 10 is supplied with the constant current Io copied by the reference current copy/distribution circuit 16*b* and supplies the regulated current Ip corresponding to a terminal pin of the organic EL panel, which is to be driven by itself, to the input terminal 11*a* of the D/A converter circuit 11 to drive input side current-mirror transistors TNa and TNp.

The D/A converter circuit 11 includes the N channel input side transistor TNa and the N channel input side transistor TNp connected in parallel to the transistor TNa. N channel output side transistors TNb~TNn are current-mirror connected to these input side transistors TNa and TNp.

Channel width (gate width) ratio of the transistor TNa to the transistor TNp is set to 1:9. A source of the transistor TNa is grounded through a resistor Ra and a source of the transistor TNp is grounded through a resistor Rpa and a switch circuit SWpa.

Incidentally, the ratio of channel width (gate width) of 1:9 may be realized by connecting, in parallel, nine (9) MOS transistors, which have good paring characteristics with respect to the one MOS transistor.

The input side transistors TNa and TNp are connected to an input terminal 11*a* and supplied with a regulated current Ip from the drive current regulator circuit 12 through the input terminal 11*a*.

In an initial portion of a drive period for which the switch circuit SWpa is in OFF state, the current Ip flows in only the input side transistor TNa, so that a peak current Ipa is generated at an output terminal 11*b* of the D/A converter circuit 11 as an output current Ia corresponding to the display data. When the switch circuit SWpa is turned ON thereafter, the drive current Ip is branched and flows in the input side transistors TNa and TNp. In this case, a normal state drive current Ia, which is one-tenth of the peak current Ipa is generated at the output terminal 11*b*.

Resistors Rb~Rn−1 are inserted between sources of the output side transistors TNb~TNn−1 and drains of transistors Trb~Trn−1, respectively. Therefore, it is possible to improve the preciseness of current paring of the D/A converter circuit 11.

Incidentally, gates of the transistors Trb~Trn−1 are connected to input terminals do~dn−1 to which the k-bit display data is inputted from the register 16. Sources of the transistors Trb~Trn−1 are grounded.

The drive current value regulation circuit 12 is a programmable current value regulation circuit whose output current value Ip can be determined by data setting and is constructed with a current-mirror drive circuit 12*a* composed of N channel MOS transistors Tr1 and Tr2, a current-mirror type current regulation circuit 12*b* composed of P channel transistors Tr3~Tr7 driven by the current-mirror drive circuit and a non-volatile memory 15.

In the current-mirror drive circuit 12*a*, a drain of the input side transistor Tr1 is connected to one of outputs of the reference current copy/distribution circuit 16*b* and receives the current Io therefrom. A source of this transistor is grounded through a resistor R1. Channel width (gate width) of the output side transistor Tr2 of the current-mirror drive circuit 12*a* to that of the transistor Tr1 is set to P times, where P is an integer equal to or larger than 2, and a drain of the transistor Tr2 is connected to a drain of the input side transistor Tr3 of the current-mirror type current regulation circuit 12*b* and a source thereof is grounded through a resistor R2.

Therefore, current P×Io flows in the output side transistor Tr2 and the transistor Tr3 is driven by this current. As a result, a mirror current of P×Io is outputted from the output side transistor Tr4.

Sources of the current-mirror connected transistors Tr3~Tr7 are connected to the power source line +VDD (=+3V) and a drain side (output side) of the output side transistor Tr4 is connected to the input terminal 11*a* of the D/A converter circuit 11. Drains of the output side transistors Tr5~Tr7 are connected to the drain of the transistor Tr4 through respective switch circuits SW1~SW3 such that the output side transistors Tr5~Tr7 are connected in parallel to the transistor Tr4. The transistors Tr5~Tr7 constitute a current value correction circuit for correcting the mirror current P×Io outputted from the output side transistor Tr4.

In this embodiment, ratio of channel width (gate width) of the transistors Tr5~Tr7 to the transistor Tr3 is set to 1/10, 1/20 and 1/40 and, for example, required preciseness of current on the output side of the D/A converter circuit 11, which is represented by 1 LSB (resolution) in a 6-bit tone, can be regulated with these ratio.

It becomes possible to regulate the drive current of the D/A converter circuit 11 by adding currents P×Io/10, P×Io/20 and/or P×Io/40 to the current P×Io by turning the switches SW1~SW3 ON selectively or as a whole. Since the drive current thus regulated is amplified correspondingly to the display data by the D/A converter circuit 11 and outputted through the D/A converter circuit 11 to the current-mirror type current output circuit 13 as the drive current of the terminal pin, the terminal pin drive current can be regulated by the drive current value regulator circuit 12. By regulating this current value, the luminance regulation of the OEL element 4*a* connected to the terminal pin becomes possible and, by regulating this value correspondingly to the respective terminal pins, it is possible to restrict luminance unevenness of the display screen. Incidentally, since a practical drive current is made 1/N by the output stage current-mirror circuit 13*b* as to be described later, this regulated current value becomes 1/N regulation as the drive current value.

The selection of the switch circuits SW1~SW3 to be ON/OFF controlled is performed according to 3-bit data stored in a predetermined region of the non-volatile memory 15. For example, when the 3-bit data is "010", the switch circuit SW2 corresponding to bit "1" is turned ON and the switch circuits SW1 and SW3 each corresponding to bit "0" are turned OFF.

The data stored in the non-volatile memory 15 is set by the MPU 8. Incidentally, the non-volatile memory 15 has a memory capacity of 3×n bits (where n is a total number of terminal pins of column lines of one driver IC) or more and a 3-bit region is assigned for every terminal pin.

The MPU 8 generates a 3-bit data for luminance regulation of every terminal pin and stores a total of 3×n bits in the non-volatile memory 15. The 3-bit data is supplied to the non-volatile memory 15 according to clock CLK as the data DAT from the MPU 8. Thus, it is possible to perform the luminance regulation for pixels in a horizontal scan direction.

On the other hand, since the pixel circuits 4 are arranged in matrix, it is impossible to solve the problem of luminance unevenness for all pixel circuits by one line in the horizontal scan direction. Therefore, the 3-bit data is generated by employing an average luminance values of the OEL elements of the pixel circuits 4 arranged at the scan positions in the same vertical direction on the screen of the organic EL display panel.

Incidentally, the 3-bit data for every terminal pin is generated by measuring the luminance of the displayed screen as a mean value of luminance of pixels of the display screen in vertical scan directions of the respective terminal pins, resulting in data DAT of totally 3n bits. In this case, 3-bit data of terminal pin, for which luminance regulation is unnecessary, is "000". It is practical that the 3-bit data is generated for every terminal pin, which requires luminance regulation.

Such luminance regulation may be possible by monitoring a display screen of an assembled product and generating the data DAT for pixels having different luminance. The thus generated 3n-bit data may be written by the MPU 8 in the test stage of the consignment of the products.

In this manner, the luminance unevenness on a display screen of the product or the luminance variation of display screens of the products can be regulated.

Assuming here that the number of vertical scan lines is m, it is possible to solve the luminance unevenness correspondingly to luminance of all pixel circuits 4 arranged in matrix by storing the luminance unevenness correction data for one screen is stored in the non-volatile memory 15 the capacity of which is 3×n×m bits and by reading them correspondingly to the vertical scan. That is, the drive current for correcting the luminance unevenness is generated by reading the luminance correction data corresponding to the vertical scan position while updating the address of the non-volatile memory 15 correspondingly to the vertical scan position by the row side scan circuit 7 shown by dotted line in FIG. 2.

FRAM, MRAM or EEPROM, etc., may be used as the non-volatile memory 15. Further, although three switch circuits SW1~SW3 are provided in this embodiment, the number of switch circuits is not limited thereto and may be 1 or larger than 3. Therefore, the data for regulating luminance may have at least one bit.

Now, the current-mirror type current output circuit 13 will be described.

The current-mirror type current output circuit 13 includes a drive current inverter circuit 13*a* and an output stage current-mirror circuit 13*b*.

The drive current inverter circuit 13*a* is a current-mirror circuit including P channel transistors TPu and TPw for inverting the output of the D/A converter circuit 11 and transmitting it to the output stage current-mirror circuit 13*b*. Source sides of these transistors are connected to the power source line +Vcc. The transistor TPu is an input side transistor having a drain connected to the output terminal

11*b* of the D/A converter circuit 11. The transistor TPw is an output side transistor having a drain side connected to the input terminal 13*c* of the output stage current-mirror circuit 13*b*.

Thus, it is possible to generate the drive current Ia in the input terminal 13*c* correspondingly to the output current Ia corresponding to the display data of the D/A converter circuit 11.

The output stage current-mirror circuit 13*b* includes an N channel MOS FET TNv inserted between the input terminal 13*c* and the input side current-mirror transistor TNx and an N channel MOS FETs TNx and TNy, which constitute the output stage current-mirror circuit. The transistor TNv constitutes a circuit for regulating the drive voltage level. Gate width ratio of the transistor TNx of the output stage current-mirror circuit 13*b* to the transistor TNy thereof is N:1. Sources of these transistors are grounded and the output side transistor TNy is connected to the output pin 9. Thus, the capacitor C of the pixel circuit 4 having the OEL element 4*a* is charged by sinking the drive current Ia/N from the terminal pin of the organic EL panel through the output pin 9 during the drive period.

Now, the generation of a peak current for charging the capacitor C at high speed will be described.

An input side transistor TNp, a resistor Rpa and a switch circuit SWpa constitute the peak current generation circuit 14. The switch circuit SWpa is turned OFF in only a constant time tp of the initial drive period and, thereafter, turned ON according to a control signal CONT from the control circuit 5.

At the start time of the drive, the switch circuit SWpa is not supplied with the control signal CONT from the control circuit 15. Therefore, a current Ip flows in the input side transistor TNa and a current, which is Ip×M where M corresponds to data set in one of input terminals do~dn−1, is generated, resulting in the peak current Ipa=M×Ip at the output terminal 11*b* of the D/A converter circuit 11. After the peak current generation period tp, the control signal CONT is generated to turn the switch circuit SWpa ON. Therefore, the current in the input side transistor TNa is branched to the input side transistor TNp. Since the gate width ratio of these transistors is 1:9, a current Ip/10 flows in the input side transistor TNa and a current 9×Ip/10 flows in the input side transistor TNp. As a result, a current, which is one tens of the peak current Ipa, is generated at the output terminal 11*b*.

Incidentally, since it is enough to initially charging the organic EL element 4 having capacitive load characteristics by the peak current, a start time point of the peak current period tp is not always necessary to be coincident with the start time of the drive.

Figure 3:
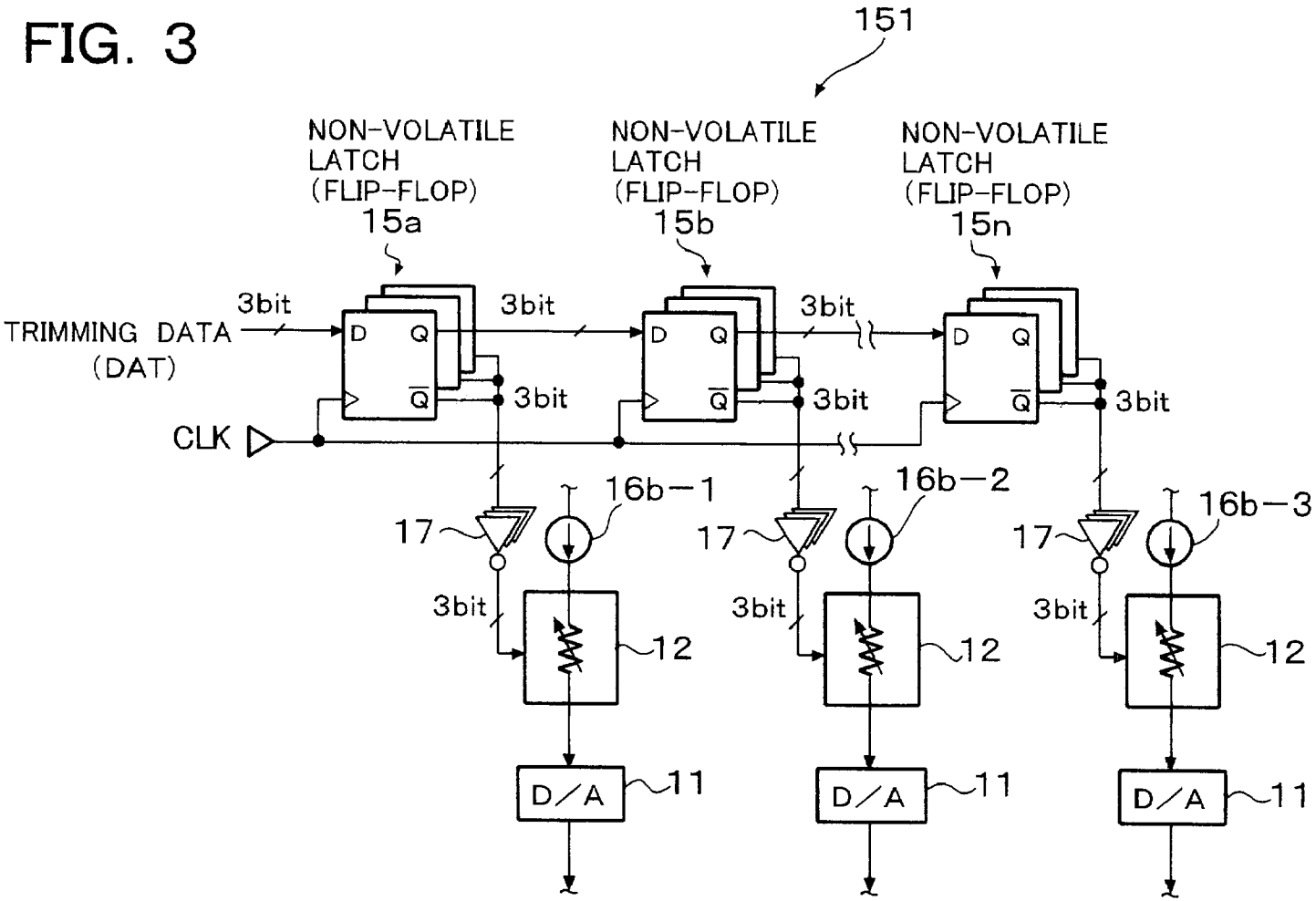
FIG. 3 is a circuit diagram of a non-volatile memory shown in FIG. 2, which is constructed with registers.

FIG. 3 shows a concrete example of the non-volatile memory 15 having a shift register construction.

A reference numeral 151 depicts n shift register stages each including three parallel-connected shift registers, where n is the number of the output pins 9. The shift register 151 is constructed by a series connection of n data latches 15*a*, 15*b*, , 15*n*, which are provided correspondingly to the respective n output pins 9 and each of which includes three flip-flops, which are parallel-arranged to form a 3-bit non-volatile memory.

The data DAT (trimming data) of 3×n bits for luminance regulation from the data latch 15*a* is serially shifted to the respective stages according to the clock CLK from the MPU 8 and stored in the data latches 15*a*~15*n* as luminance regulation data.

Inverted outputs Q (over bar) of the three flip-flops in each stage are outputted to the switch circuits SW1~SW3 of the drive current regulator circuit 12 corresponding to the respective terminal pins through three parallel inverters 17 to selectively turn the switch circuits ON/OFF correspondingly to the respective output pins 9. Thus, the luminance variation of the products or luminance unevenness of the display screen is reduced by regulating the luminance of the OEL elements, which are driven through the respective output pins 9.

Figure 4:
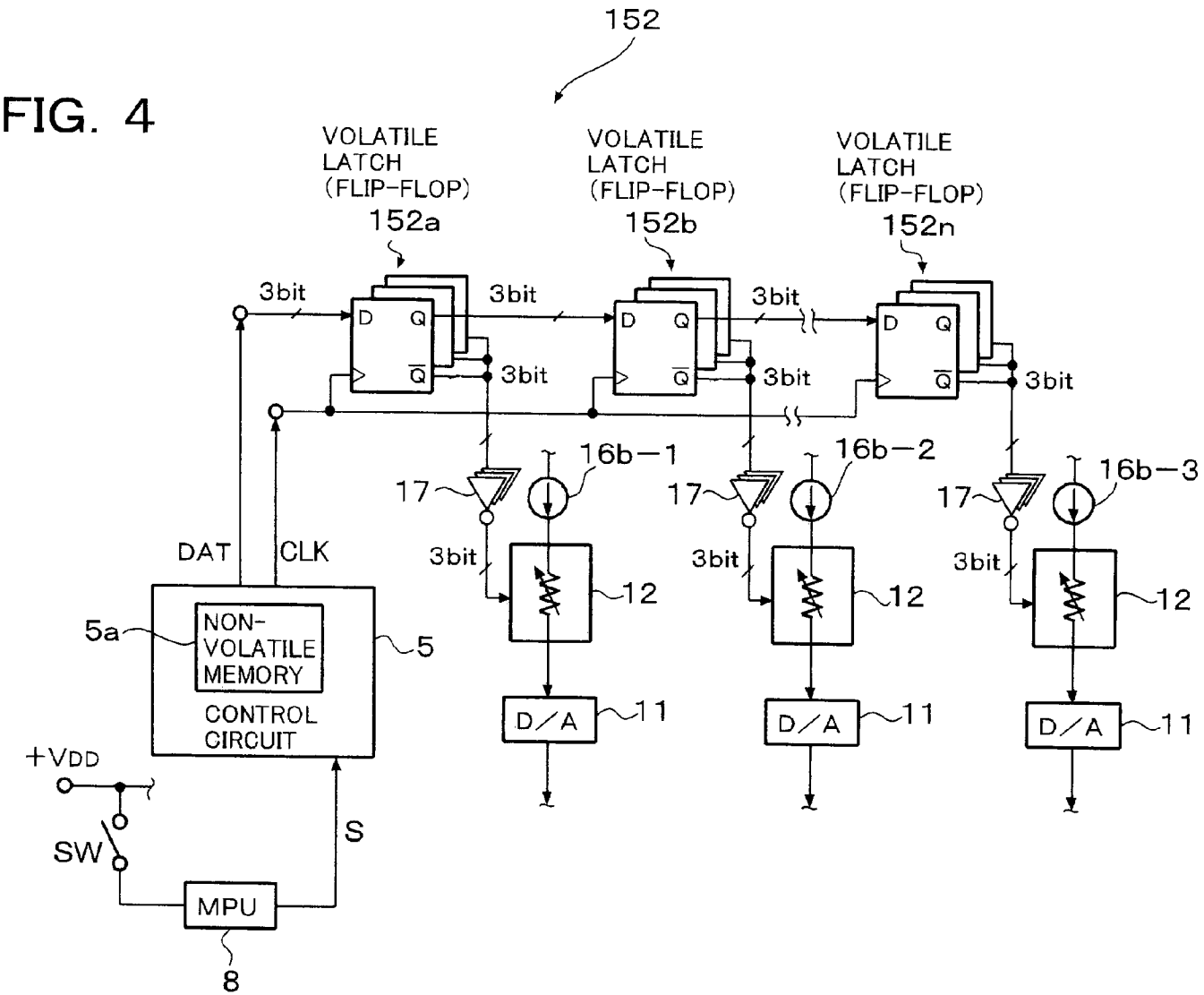
FIG. 4 is a circuit diagram of a non-volatile memory shown in FIG. 3, which is constructed with shift registers using volatile memories.

FIG. 4 shows an example of the non-volatile memory 15, which is constructed with volatile memories.

A shift register 152 shown in FIG. 4 includes a series connection of n volatile latches 152*a*, 152*b*, . . . , 152*n* each including parallel-connected three flip-flops for latch data.

The 3-bit parallel data DAT (trimming data) is inputted to the latch 152*a* bit-serially from not a MPU 8 but the control circuit 5. Simultaneously therewith, the latches 152*a* ~152*n* store the luminance regulation data according to a clock CLK from the control circuit 5.

The trimming data DAT is stored in a non-volatile memory 5*a* provided in the control circuit 5. The MPU 8 generates a control signal S when a power source switch SW is turned ON. Upon the control signal S from the MPU 8, the control circuit 5 generates the clock signal CLK and the trimming data DAT and writes the trimming data DAT in the shift register 152.

The trimming data DAT (luminance regulation data) stored in the non-volatile memory 5*a* is written from the MPU 8 according to data externally inputted to the MPU 8 through a keyboard, etc.

In this case, the control circuit 5 may be the MPU 8 as in the case shown in FIG. 3. The volatile memory for storing the luminance regulation data is not limited to such shift register. It may be such as RAM, etc.

In FIG. 3 and FIG. 4, current sources 16*b*-1, 16*b*-2, 16*b*-3, . . . are constant current sources supplying the currents Io, respectively, on the output side of the reference current copy/distribution circuit 16*b*.

Figure 5:
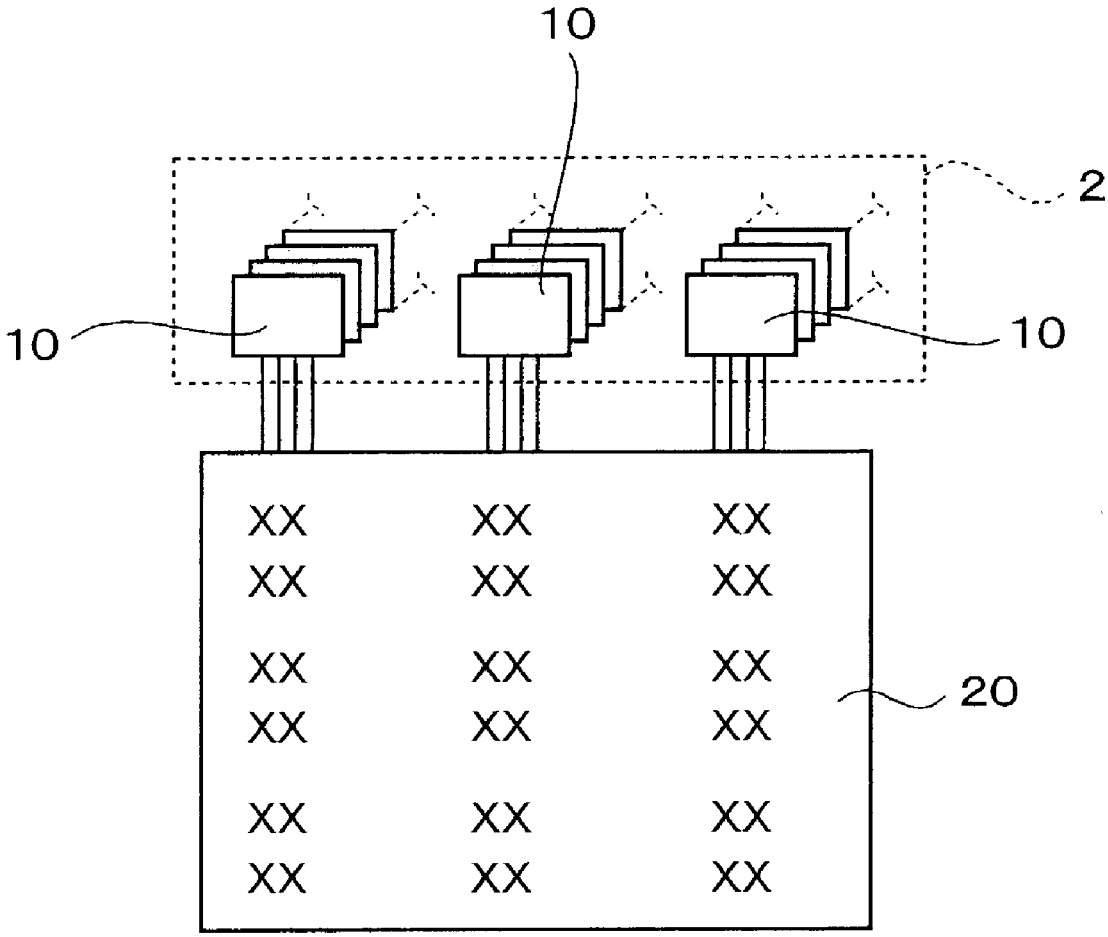
FIG. 5 illustrates a driving of a pixel circuit by dispersing terminal pin drive circuits having the current value regulation circuits.

FIG. 5 shows another embodiment of the present invention, which, in order to regulate luminance unevenness, current drive circuits 10 including the drive current value regulation circuits 12, respectively, are provided as circuits for driving specific pixel circuits among the pixel circuits arranged in matrix, which are arranged at specific positions "X" on the screen of the organic EL panel.

As described previously, in the case where the luminance unevenness correction data for one screen is stored in the non-volatile memory 15, the luminance correction for the pixel circuits for one screen is possible provided that the capacity of the non-volatile memory 15 is 3×n×m. In such case, however, the capacity of the non-volatile memory 15 becomes to large and a control thereof is also difficult. The embodiment shown in FIG. 5 can solve the above problem.

In the embodiment shown in FIG. 1, the current drive circuits 10 are provided correspondingly to the respective scan positions and include the drive current value regulator circuits 12, respectively. Therefore, each drive current value regulator circuit 12 is common for the pixel circuits 4 in the vertical direction, so that only averaged luminance correction is possible for vertically arranged pixel circuits 4 in the same horizontal scan positions.

In view of this, in the embodiment shown in FIG. 5, the current drive circuit 10 having the drive current value regulator circuit 12 is provided correspondingly to a location (location of pixel circuit) at which luminance unevenness is conspicuous to correct luminance at that location. Thus, it is possible to reduce the amount of correction data.

As the locations on the screen 20 shown in FIG. 5, at which luminance unevenness is conspicuous, a center portion and portions on both sides thereof may be considered as shown by "X". The current drive circuits 10 having the drive current value regulator circuits 12 are arranged correspondingly to the locations shown by "X". The current drive circuits 10 other than these locations do not have the drive current value regulator circuits 12, as shown in FIG. 2. When the positions of the vertically arranged pixel circuits for which luminance unevenness is to be regulated are scanned, the current drive circuits in one horizontal scan line, which correspond to the pixels thereof, are invalidated and the luminance-corrected drive currents are outputted from the current drive circuits 10 having the drive current value regulator circuits 12 and provided correspondingly to the pixels to the respective output pins 9. Since the amount of correction data, which is for the positions at which the luminance unevenness is corrected, is enough, the memory capacity of the non-volatile memory 15 can be reduced correspondingly, so that the circuit size of the drive current output circuit can be reduced.

Incidentally, the locations "X" requiring luminance unevenness correction, which have the same horizontal scan positions and different vertical scan positions, can commonly use the same current drive circuit 10 having the drive current value regulator circuit 12.

In concrete, the current drive circuit 10 having the drive current value regulator circuit 12 becomes a current drive circuit having no drive current value regulator circuit when the drive current value regulator circuit is made inoperable or the data for the regulated current value is set to "0". That is, the current drive circuits 10 provided correspondingly to the pixel circuits to be corrected are realized by reading data for correcting the drive current value of pixel circuits, which are driven correspondingly to the vertical scan, from the non-volatile memory 15 and setting it. Therefore, in such case, it is enough, in the horizontal scan positions corresponding to the positions marked "X", to make only correction data stored in the non-volatile memory 15 correspondingly to the respective vertical scan positions different and access the respective data correspondingly to the vertical scans.

Although, in the described embodiments, the drive current value regulator circuit 12 is provided in the input stage of the current drive circuit 10 supplied with the reference drive current, this circuit may be provided between the input stage (or initial stage) and the output stage for current-driving the terminal pin of the organic EL panel.

The control for writing and resetting the voltage value for the capacitor of the pixel circuit in the embodiments is a mere example and it is determined according to the number of transistors of the pixel circuit or the number of the selection lines or scan lines connected thereto.

Since a current drive circuit for monochromatic display may be used as the current drive circuit of the present invention, it is not necessary to provide the current drive circuits correspondingly to the respective R, G and B.

Although this embodiment is constructed with MOS FETs mainly, it can be constructed with using bipolar transistors. Further, in the described embodiment, the N channel (or npn) transistors may be replaced by P channel (or pnp) transistors or vice versa.

What is claimed is:

1. A drive circuit for driving an active matrix type organic EL display panel, including a plurality of matrix-arranged pixel circuits, each including an organic EL element, a capacitor for storing a voltage value corresponding to a drive current value of said organic EL element, and transistors for outputting the drive current to said organic EL element correspondingly to the voltage value, comprising:

a plurality of current drive circuits having output pins connected to data lines or column lines of said organic EL display panel, for generating charging currents for charging said capacitors of said pixel circuits to the voltage values; and a write control circuit for performing a write control for storing the voltage value in said capacitor and a reset control for resetting the voltage value in said capacitor; and a D/A converter circuit, wherein a plurality of said current drive circuits, including current value regulator circuits for regulating output currents discharged from said output pins or sunk to said output pins, respectively, are connected to a plurality of said pixel circuits, in arranged at least dispersed positions on said screen of said organic EL display panel, through said output pins, wherein said D/A converter circuit is supplied with a current from said current value regulator circuit, and converts a display data into an analog current value according to the current from said current value regulator circuit, wherein said current value regulator circuit is capable of regulating a current value according to externally set at least 1-bit data and is responsive to a current to be outputted to said output pin or a basic current of the current to be outputted to said output pin to regulate the output current, wherein the output current is generated according to the analog current value and sunk to said output pin, and the plurality of said current drive circuits have said current value regulator circuits, respectively, and wherein said current value regulator circuit includes a switch circuit for ON/OFF controlling the data stored in a memory and a current value generator circuit for generating a predetermined current value according to the current to be outputted to said output pin or the basic current of the current to be outputted to said output pin and an ON/OFF operation of said switch circuit and outputting the predetermined current value to said D/A converter circuit, and said memory is non-volatile memory written with the data or a volatile memory written with the data transferred from a non-volatile memory provided externally of said current value regulator circuit.

2. A drive circuit of an active matrix type organic EL display panel, as claimed in claim 1, wherein said memory is a non-volatile memory and said write control circuit performs a write control for storing the voltage value in said capacitor through a scan line and a reset control for resetting the voltage value of said capacitor through another scan line.

3. A drive circuit of an active matrix type organic EL display panel, as claimed in claim 1, wherein said current drive circuit further includes a first current-mirror circuit for generating the output current at said output pin in responsive to an output of said D/A converter circuit, said first current-mirror circuit sinks a current from said data line or said column pin to ground through said output pin and a current ratio between an input side and an output side of said first current-mirror circuit is n:1, where n is an integer equal to or larger than 2.

4. A drive circuit of an active matrix type organic EL display panel, as claimed in claim 3, further comprising a scan circuit connected to a cathode side of said organic EL element, a first scan line and a second scan line, wherein said write control circuit performs the write control for writing the voltage value in said capacitor through at least said first scan line and the reset control for resetting the voltage value of said capacitor through at least said second scan line and said scan circuit grounds the cathode sides of a plurality of organic EL elements driven by the drive current after the write of the voltage value for said capacitor is terminated.

5. A drive circuit of an active matrix type organic EL display panel, as claimed in claim 4, wherein said current value generator circuit includes a second current-mirror circuit including a first and second output side transistors current-mirror connected to an input side drive transistor, said second output side transistor is connected in parallel to said first output side transistor through said switch circuit and the predetermined current value is generated on an output side to which said first and second output side transistors are connected in parallel.

6. A drive circuit of an active matrix type organic EL display panel, as claimed in claim 5, wherein a plurality of said second output side transistors and a plurality of said switch circuits are provided, said data line or said column terminal pin is provided for every one of said R, G or B pixels of said screen of said organic EL display panel in the horizontal scan direction, said memory is constructed with flip-flops in a plurality of stages the number of which corresponds to that of said data lines or said column terminal pins and said flip-flops in each stage corresponding in number to said switch circuits are provided in parallel.

7. A drive circuit of an active matrix type organic EL display panel, as claimed in claim 6, wherein said D/A converter circuit is constructed with a third current-mirror circuit, the output current of said current value regulator circuit drives an input side transistor of said third current-mirror circuit and said first current-mirror circuit is driven by an output side transistor of said third current-mirror circuit.

8. An organic EL display device including a drive circuit of an active matrix type organic EL display panel as claimed in any one of claims 1 to 7.

* * * * *